US010788232B2

(12) United States Patent
Zhou

(10) Patent No.: US 10,788,232 B2
(45) Date of Patent: Sep. 29, 2020

(54) AIR CIRCULATION SYSTEMS AND METHODS

(71) Applicant: INNOVATIVE BUILDING ENERGY CONTROL, Lake Forest, CA (US)

(72) Inventor: Gangyi Zhou, Lake Forest, CA (US)

(73) Assignee: Innovative Building Energy Control, Lake Forest, CA (US)

( * ) Notice: Subject to any disclaimer, the term of this patent is extended or adjusted under 35 U.S.C. 154(b) by 35 days.

(21) Appl. No.: 15/791,336

(22) Filed: Oct. 23, 2017

(65) Prior Publication Data

US 2018/0216843 A1 Aug. 2, 2018

Related U.S. Application Data

(60) Provisional application No. 62/411,410, filed on Oct. 21, 2016.

(51) Int. Cl.

| | |
|---|---|
| ***F24F 11/46*** | (2018.01) |
| ***F24F 11/54*** | (2018.01) |
| ***F24F 11/56*** | (2018.01) |
| ***F24F 11/79*** | (2018.01) |
| ***F24F 7/06*** | (2006.01) |
| *F24F 110/10* | (2018.01) |
| *F24F 120/12* | (2018.01) |
| *F24F 140/40* | (2018.01) |
| *F24F 7/00* | (2006.01) |

(52) U.S. Cl.

CPC ..... *F24F 11/46* (2018.01); *F24F 7/06* (2013.01); *F24F 11/54* (2018.01); *F24F 11/56* (2018.01); *F24F 11/79* (2018.01); *F24F 7/065* (2013.01); *F24F 2007/005* (2013.01); *F24F 2110/10* (2018.01); *F24F 2120/12* (2018.01); *F24F 2140/40* (2018.01)

(58) Field of Classification Search

CPC .. F24F 11/46; F24F 11/56; F24F 11/54; F24F 11/79; F24F 7/06; F24F 2140/40; F24F 2110/10; F24F 7/065

USPC ..... 165/237

See application file for complete search history.

(56) References Cited

U.S. PATENT DOCUMENTS

2006/0099904 A1* 5/2006 Belt ..... F24F 7/06 454/236

2010/0323604 A1 12/2010 Duffe (Continued)

FOREIGN PATENT DOCUMENTS

| | | |
|---|---|---|
| CN | 2436701 Y | 6/2001 |
| CN | 204100476 U | 1/2015 |

*Primary Examiner* — Joel M Attey

(74) *Attorney, Agent, or Firm* — Stetina Brunda Garred and Brucker

(57) ABSTRACT

Systems and methods for air flow circulation are described which utilize one or more air conditioning units as well as transfer grilles to move cooler air from one space to another. The transfer grilles can include bi-directional in-line fans to move air between spaces in discrete ducts located between the spaces. Motorized dampers can be controlled by a controller that receives information about various rooms and areas from temperature and occupancy sensors within those rooms or areas. In this manner, conditioned air can be directed to those rooms that are occupied and whose temperature needs correction based on a thermostat setting, and use of the air conditioning unit can be avoided when a cool air source is present in another space.

3 Claims, 6 Drawing Sheets

(56) References Cited

U.S. PATENT DOCUMENTS

2012/0072031 A1* 3/2012 Elliott ..... G05B 15/02
700/277
2015/0285524 A1 10/2015 Saunders

* cited by examiner

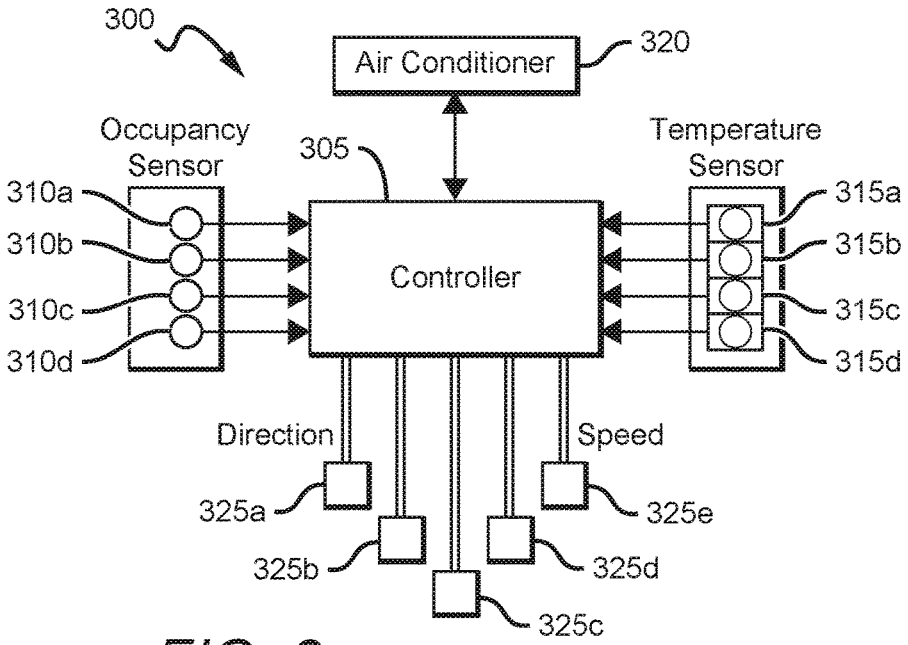
FIG. 3
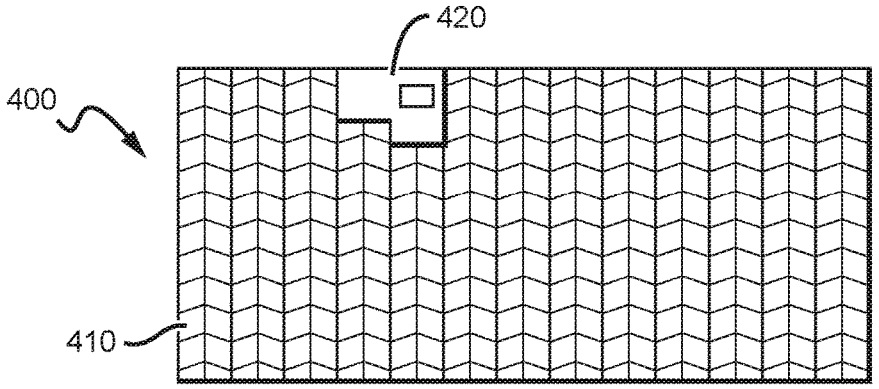
FIG. 4(a)
FIG. 4(b)
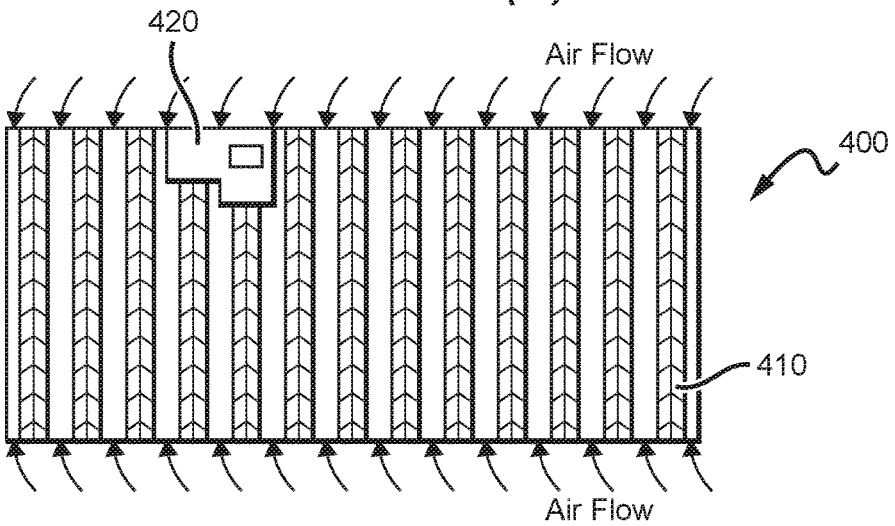

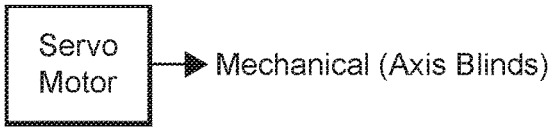
FIG. 5(a)
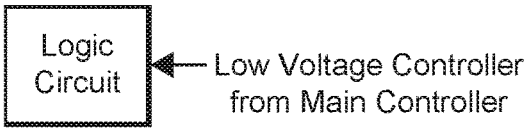
FIG. 5(b)
FIG. 6
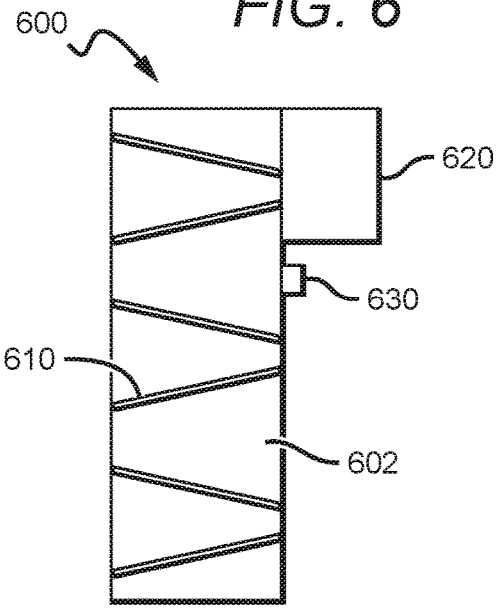
FIG. 7
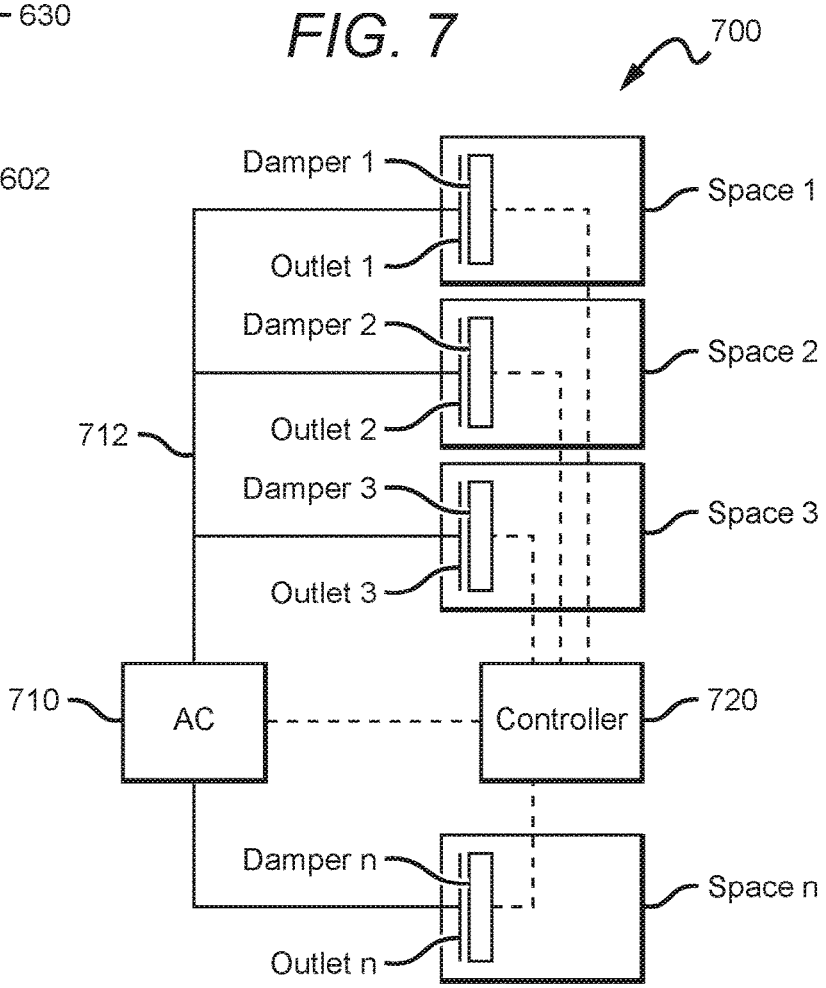

AIR CIRCULATION SYSTEMS AND METHODS

This application claims priority to U.S. provisional application having Ser. No. 62/411,410, filed on Oct. 21, 2016. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is air circulation technologies.

BACKGROUND

The background description includes information that may be useful in understanding the present invention. It is not an admission that any of the information provided herein is prior art or relevant to the presently claimed invention, or that any publication specifically or implicitly referenced is prior art.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Traditional air conditioning systems in a building, for example, are composed of four major parts: a) the air-conditioning or HVAC unit, b) cold air supply ducts, c) return air ducts, and d) a thermostat. FIG. 1 is an illustration for a typical air conditioning system in a large home. The cold air duct begins at the supply plenum of the air conditioning unit and connects with all the supply diffusers distributed in the space. The return ducts connect the return diffusers with the return plenum on the air conditioning unit. The thermostat senses a temperature at the area where it is installed and cycles the air conditioning unit on/off based on the sensed temperature.

Such systems have many inherent problems, especially in larger spaces. For example, the cooling equipment and the air distribution system are the two major components affecting air conditioning performance in a building. Unfortunately, there is no mechanism to diffuse the cold air efficiently in the building according to occupancy status and requirements of specific areas within the building.

Another problem is that current systems are unable to provide temperature distribution consistent with the expectation of those occupying the space. This is because the air conditioning system turns on and off according to the temperature where the thermostats are located, whereas each room within a building normally has a different actual temperature and requirement than that where the thermostat is located.

Still another problem is that typical building air conditioning systems are oversized for the location having an extreme heating load (e.g., the warmest area or portion of a building). The heating load relates to the heat transfer through opaque objects, solar heat gains through windows, and occupant density. As the heating load can vary significantly in a given space or building, air conditioning units are typically sized for the location with the largest heating load, which might be the area closest to the window facing southwest and/or the area with high occupancy. Thus, energy is often wasted due to the use of oversized equipment, and people often feel uncomfortable in the cold spots or where the heating load is lowest.

Thus, there remains a need for an improved air circulation system that efficiently circulates air among different sections or areas within a building to bring the temperature and air pressure to equilibrium.

SUMMARY OF THE INVENTION

The inventive subject matter provides apparatus, systems, and methods for effectively circulating air among different rooms or areas within a structure to equalize temperature and pressure across the different rooms/areas.

Preferred air circulation systems comprise multiple ducts that are separate from the HVAC system of the structure. Each duct may connect a pair of adjacent rooms or connect different sections within the same room, and include a bi-directional inline fan that is capable of producing variable speed air flow. In some embodiments, the bi-directional inline fan is electronically or mechanically controllable (e.g., powering on/off, fan speed, etc.). Additionally, the preferred air circulation systems may also include electronically controllable dampers at one or more openings of the HVAC ducts. The system can control these dampers to vary the amount of opening and airflow to a room and thereby control the air pressure within each room of the structure.

Contemplated air circulation systems may also include one or more sensors of different types (e.g., occupancy sensors, temperature sensors, pressure sensors, etc.) within each room of the structure. The systems also include a controller that is communicatively coupled with the sensors in the rooms, the bi-directional inline fans in the ducts, and the dampers. The centralized controller can be implemented as a circuitry or a programmable processor with memory that stores software instructions. In some embodiments, the controller is configured to receive or retrieve sensor data from the different sensors in the rooms and coordinate the bi-directional inline fans and the dampers in the different ducts to thereby control circulation of air among the rooms based on the data from the sensors to achieve substantial equilibrium of temperature and air pressure among all specified rooms.

In some embodiments, the controller is also communicatively coupled with the HVAC unit of the structure, and may be configured to control the HVAC unit (e.g., powering on/off, power settings, temperature settings, etc.) based on the sensor data. It is contemplated that the controller can be further programmed to coordinate use of the HVAC unit with the bi-directional inline fans and dampers to control the temperature and air pressure across all rooms within the structure, while reducing power use of the system. For example, where temperature requirements can be met with the use of the bi-directional inline fans and dampers, the HVAC unit can remain powered off.

It is also contemplated that the bi-directional inline fans can provide for variable speed air flow or constant speed air flow. The inline fans are controlled by the controller which collects temperature readings at different locations and the occupancy at different rooms. Using predefined logic, the controller sends command signals to each inline fans based on the sensed data. Thus, the inline fans are capable of moving air within the ducts and rooms to cause the occupied rooms to have a desired room temperature. Advantageously, through the use of the in-line fans, the controller needs only to power on or request use of the air conditioning unit when the occupied rooms cannot reach the desired condition by the air movement driven by inline fans alone. Using the systems and methods contemplated herein, the size of the air conditioning unit can be reduced, and the need for an oversized unit is eliminated.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 3 illustrates a schematic of one embodiment of a controller for an air circulation system.

FIGS. 4(*a*) and 4(*b*) illustrate one embodiment of a damper with a motor controller.

FIGS. 5(*a*) and 5(*b*) illustrate one embodiment of a motor controller for a damper.

FIG. 6 illustrates a schematic of a damper of some embodiments.

FIG. 7 illustrates a schematic of an air circulation system of some embodiments.

DETAILED DESCRIPTION

It should be noted that any language directed to a computer should be read to include any suitable combination of computing devices, including servers, interfaces, systems, databases, agents, peers, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
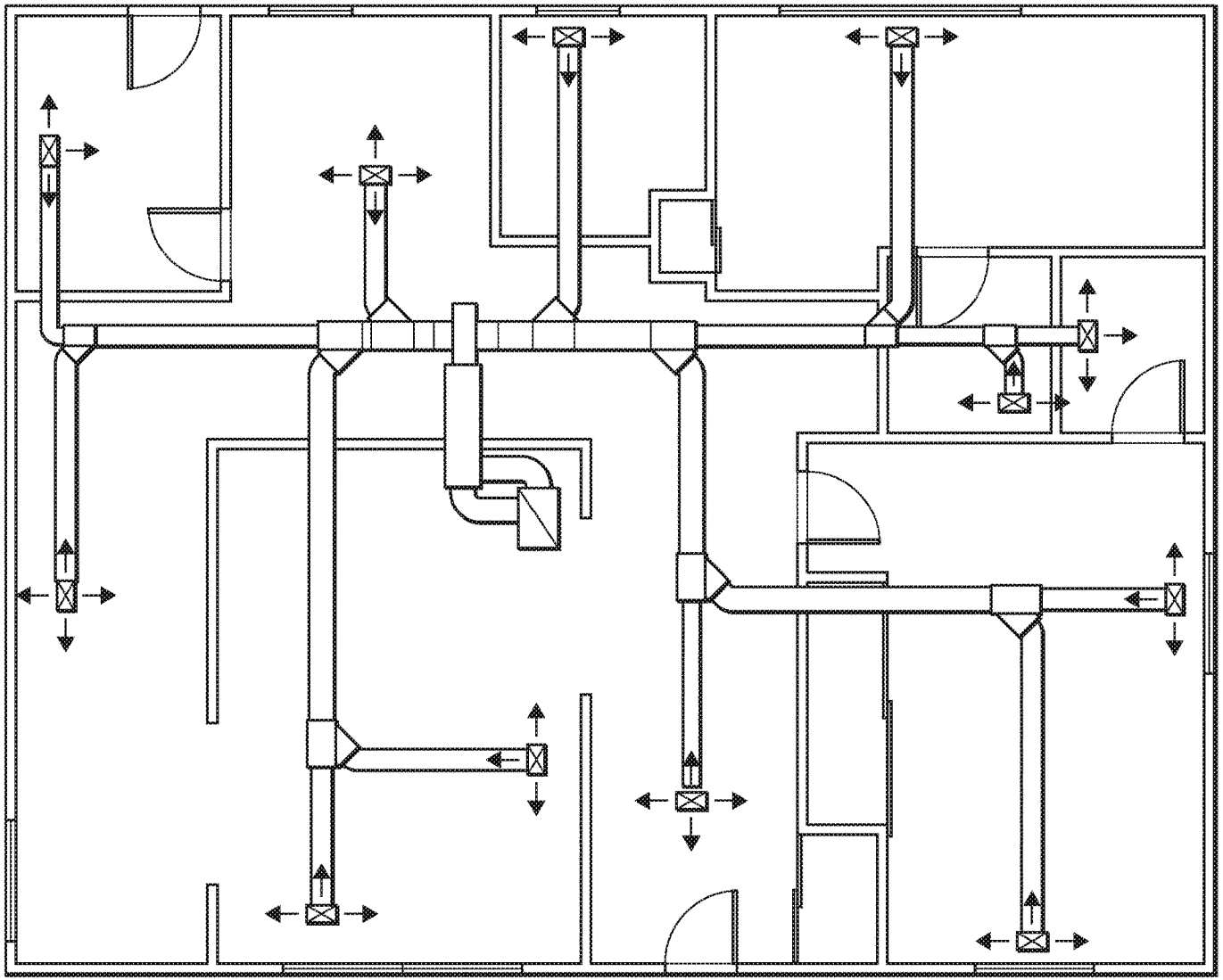
FIG. 1 illustrates a schematic of an air conditioning system within a structure.
Figure 2:
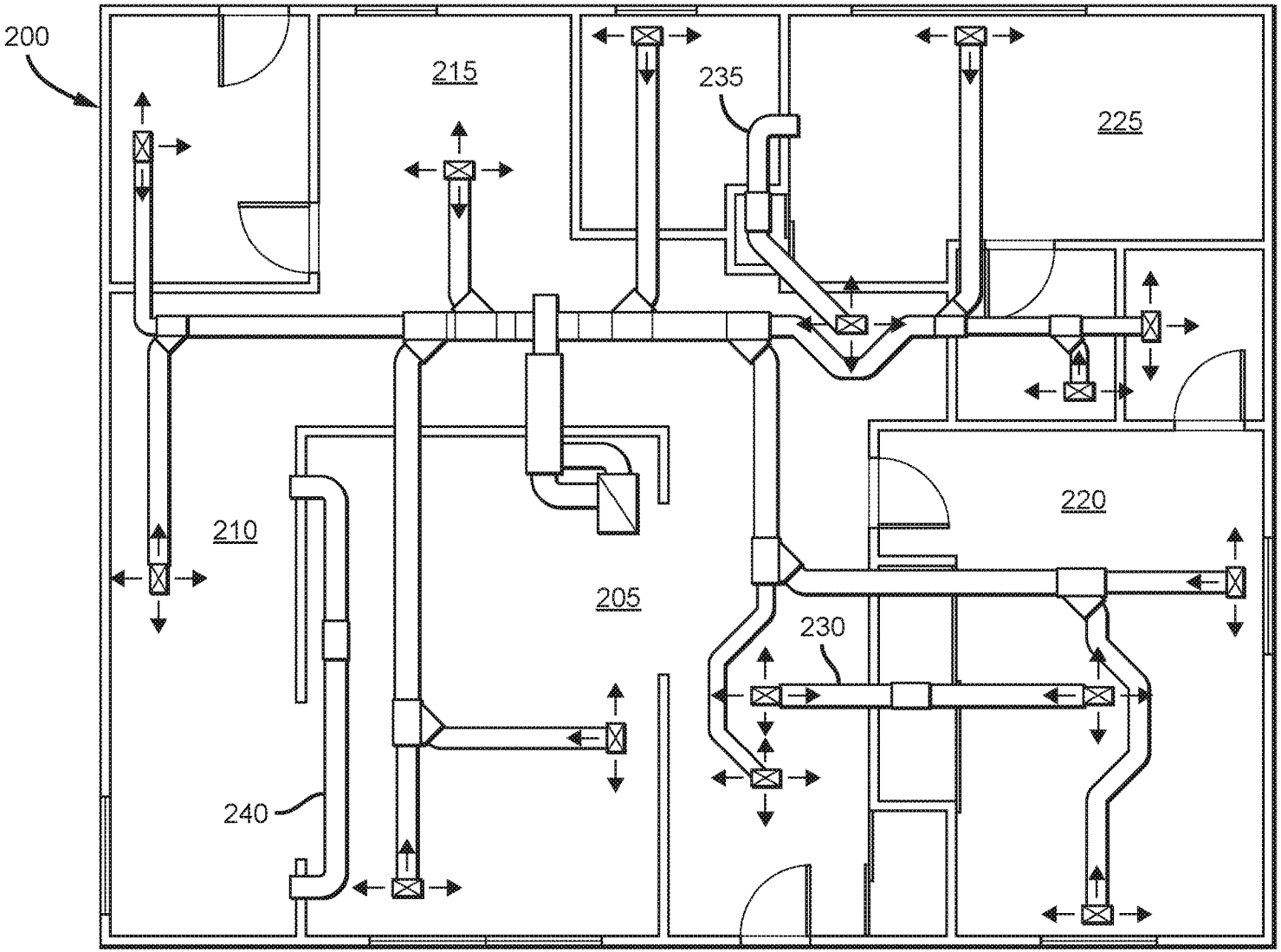
FIG. 2 illustrates a schematic of one embodiment of an air circulation system within a structure.

FIG. 2 illustrates one embodiment of an air circulation system 100 for a structure 200. Although the structure 200 is shown as a residence, it is contemplated that the structure could be a single or multi-level building for residential, commercial, and/or industrial use. As shown, the structure 200 can include multiple rooms—here, living room 205, dining room 210, kitchen 215, and bedrooms 220 and 225.

The system 100 preferably includes multiple air ducts, such as duct 230, duct 232, duct 235, and duct 240. Outlets of duct 240 are both disposed in dining room 210 to allow airflow from one portion of the dining room 210 to another portion. Duct 230 connects the living room 205 and the bedroom 220 to permit airflow between those rooms. Duct 235 connects the living room and the bedroom 225 to permit airflow between those rooms. Duct 232 is a supply duct feeding conditioned air from the HVAC equipment 260 to the various rooms in the structure 200. The specific locations of the ducts and the rooms they connect can be varied depending on the structure's layout and the purpose and occupancy of the rooms and/or areas of the structure. Each of the ducts 230, 235, and 240 preferably includes a bi-directional fan 285 that is electronically or mechanically controllable from a controller 270.

Temperature sensors 280, which could be thermostats, are disposed in various areas of the structure. Although not shown in FIG. 2, different types of sensors (e.g., occupancy sensors, air pressure sensors, etc.) may also disposed within each of these rooms—the living room 205, the dining room 210, the kitchen 215, the bedroom 220, and the bedroom 225. In addition, temperature sensors could be disposed in others of the rooms without departing from the scope of the invention.

Controller 270 is communicatively coupled with the temperature sensors 280 and other sensors that may be present, the bi-directional inline fans 285, and mechanical dampers, and is programmed to retrieve or receive sensor data from the temperature sensors 280 and other sensors that may be present, and adjust a setting of at least one of the bi-directional inline fans 285 to achieve equilibrium of temperature and air pressure among the rooms or within a room in the structure 200. For example, if a temperature sensed by sensor 280 in the dining room 210 is above a set threshold, the inline fan 285 in duct 240 can be powered on to move air from a cooler region to a warmer region of the dining room 210. In some embodiments, the controller 270 is further configured to utilize sensor data from the one or more sensors to adjust a setting of at least one mechanical damper to achieve a desired temperature. This could include opening or closing of a damper, as needed.

FIG. 3 illustrates a schematic of one embodiment of a controller 305 for use in the system and methods described in FIG. 2 and herein. The controller 305 is communicatively coupled with a plurality of occupancy sensors 310*a*-310*d*, a plurality of temperature sensors 315*a*-315*d*, an air conditioning (HVAC) unit 320, and mini-controllers 325*a*-325*d* that are each configured to a control a bi-directional inline fans and/or damper. Although only two types of sensors are shown, it is contemplated that other types of sensors could also be used (e.g., air pressure sensors, etc.). The controller 305 is preferably programmed to retrieve or receive sensor data from the occupancy sensors 310*a*-310*d* and temperature sensors 315*a*-315*d*, and retrieve or receive information (e.g., power setting information, temperature setting information, etc.) from the air conditioning unit 320. The controller 305 is further configured to determine a set of coordinated settings for each of the bi-directional inline fans and dampers, and to send out signals to adjust the settings of the bi-directional inline fans and dampers via the mini-controllers 325*a*-325*d* according to the determined set of coordinated settings.

FIGS. 4(*a*) and 4(*b*) illustrate one embodiment of a mechanical damper 400 that could be used in-line or at an outlet of a duct. Preferred dampers are sized and dimensioned to cover an outlet of the HVAC outlet. The damper 400 includes two main components: shutter blinds 410 and a motor controller 420 for rotating or otherwise moving the shutter blinds 410.

As shown in the status of FIG. 4(*a*), the damper 400 is fully closed when the shutter blinds 410 are fully expanded by the motor controller. The blinds 410 are otherwise open to a certain degree when the axis of the shutter blinds 410 is rotated to some extent by the motor controller 420. The rotating angle of the axis, and thus the motor controller 420, is flexible and determined by the whole system and a central controller when parameters such as wind speed, pressure and temperature are concerned. A specific amount of air could pass through the air gap between shutter blinds as shown in FIG. 4(*b*).

The motor controller 420 in FIG. 4(*a*) preferably includes a Servo motor for controlling a position of the mechanical shutter blinds 410 and a logic circuit configured to analyze signals received from a central controller as shown in FIG. 5(*a*) and FIG. 5(*b*), respectively.

A cross section view of another embodiment of a damper 600 is shown in FIG. 6, in which shutter blinds 610 are at least partially open. Note that a pressure sensor 630 can be installed near the motor controller 620. The pressure sensor 630 is preferably configured to transmit real-time or near-real-time measurement of air pressure within the duct 602 to a central controller for further control of the damper 600, such as if air pressure in the duct is too great, the damper can be caused to open via the controller.

FIG. 7 illustrates another embodiment of an air circulation system 700 that could be disposed within a structure or building. To simplify the below explanation, it is presumed that the building has a single HVAC unit 710, although multiple units could be used so long as they are communicatively coupled with a controller.

The different spaces (space 1, space 2, space 3 . . . space n) in FIG. 7 can represent any type of individual space, including bedrooms, living rooms, conference rooms, offices, custody rooms, halls, warehouses, etc., or sections thereof. Each of the spaces can include an air outlet (outlet 1-outlet n) though which cool air can flow into the space from the air conditioning unit 710 via the branch HVAC plumbs 712.

The unit 710 and dampers (damper 1-damper n) are connected to and controlled by a central controller 720 via a wired connection, although wireless connections to one or more components are also contemplated. Based on the data received, the controller 720 is configured to determine appropriate responses, such as whether to turn on or off the AC unit 710, whether or not to open one or more of the dampers (damper 1-damper n) for a specific space, depending on how much air flow is needed for each space.

As an example, the controller 720 may detect that space 3 is occupied by some people based on data received from an occupancy sensor in that space, and requires cooling, while the other spaces are empty and there is no cooling requirements. In such example, the controller 720 can (1) send a signal to the unit 710 to power on the AC supply, and (2) send a signal to damper 3 to open the damper to allow air to flow into space 3. Since the other spaces are empty, there is less need for cold air to those spaces. Thus, in some embodiments, the controller 720 may also send a signal to the other dampers in the remaining spaces to close those dampers or maintain the dampers in a very low open angle (small openings). Where the dampers were previously closed, no signal maybe needed.

If space 3 requires additional cool air from unit 710 but there is high pressure within the duct 712 because the other dampers are closed or partially closed, controller 720 can be further configured to periodically retrieve sensor data from the temperature sensors, occupancy sensors, and pressure sensors coupled with the controller 720. If the pressure within duct 712 exceeds a predetermined threshold, the controller 720 can send a signal to one or more dampers to cause them to open to relieve the pressure within the duct 712. The dampers can then be closed when the unit 710 is powered off or when the pressure returns to a predetermined range or level.

Figure 9:
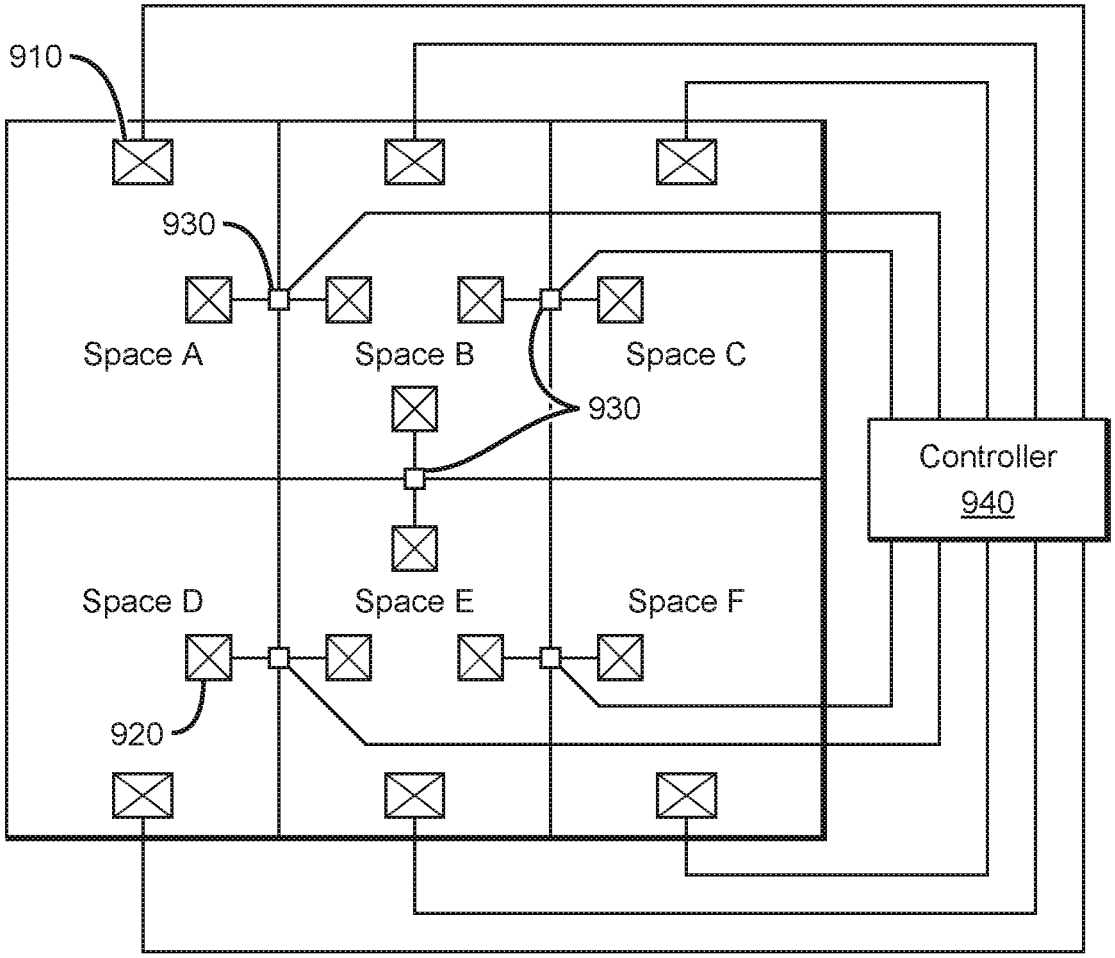
FIG. 9 illustrates a schematic of an air circulation system of some embodiments.

In a transfer grille (or internal air circulation) system, the main goal is to balance air conditions within a room or area or between rooms or areas by exchanging air from different spaces. By recirculating air, this can improve the overall efficiency of the system. As shown in FIG. 9, a sample structure could include six spaces (e.g., space A-space F) with each space having an air outlet 910 connected to the HVAC source (not shown). Here, the spaces A-F could be any type of space within a building, e.g., bedroom, living room, conference room, custody room, hall, warehouse, etc. Each HVAC outlet 910 preferably includes a controllable damper, such as that discussed above.

Each space A-F can further include one or multiple independent transfer grilles 920. The transfer grilles 920 have ducting that is independent from and not connected to the HVAC system, including the A/C ducts. Instead, the ducts of the transfer grilles 920 preferably allow air flow from one space to another without passing by the HVAC unit. A bidirectional fan 930 is preferably disposed within each transfer grille 920 to drive the air back or forth for the air exchange between the connected spaces. The fans 930 are also connected to and controlled by the controller 940, as are the AC supply and dampers.

The system can therefore allow for cool air to flow into one or more spaces via the HVAC unit and dampers, or allow airflow between spaces via the transfer grilles 920. It is preferred that the HVAC unit, the dampers, the inline fans 930 are all controlled by controller 940, which can receive data from one or more temperature, occupancy, pressure or other types of sensors disposed through the structure. It is contemplated that the controller 940 can be programmable and customized for different building sizes, space functions and HVAC loadings.

Some independent variables or parameters can be measured as input to the controller 940 for triggering different command signals. The independent input variables could be any measurable parameters for the space requirements. For example, the controller 940 can intermittently monitor temperature, air pressure, and air humidity of each space and provide different signals to the HVAC unit, the dampers, and the bi-directional fans 930 of the transfer grilles 920 based on the retrieved data. Here, the occupancy refers to the status that the space needs to be kept at a specific condition. For example, it is necessary to keep a relatively constant low temperature for one room when it is occupied by power supplies, network servers, or any other heat-generating equipment. In other words, the room is occupied and the occupancy status is "Yes". Another common example is that another room may need to be kept at a comfortable temperature and air pressure when it is occupied by people or animals.

Figure 8:
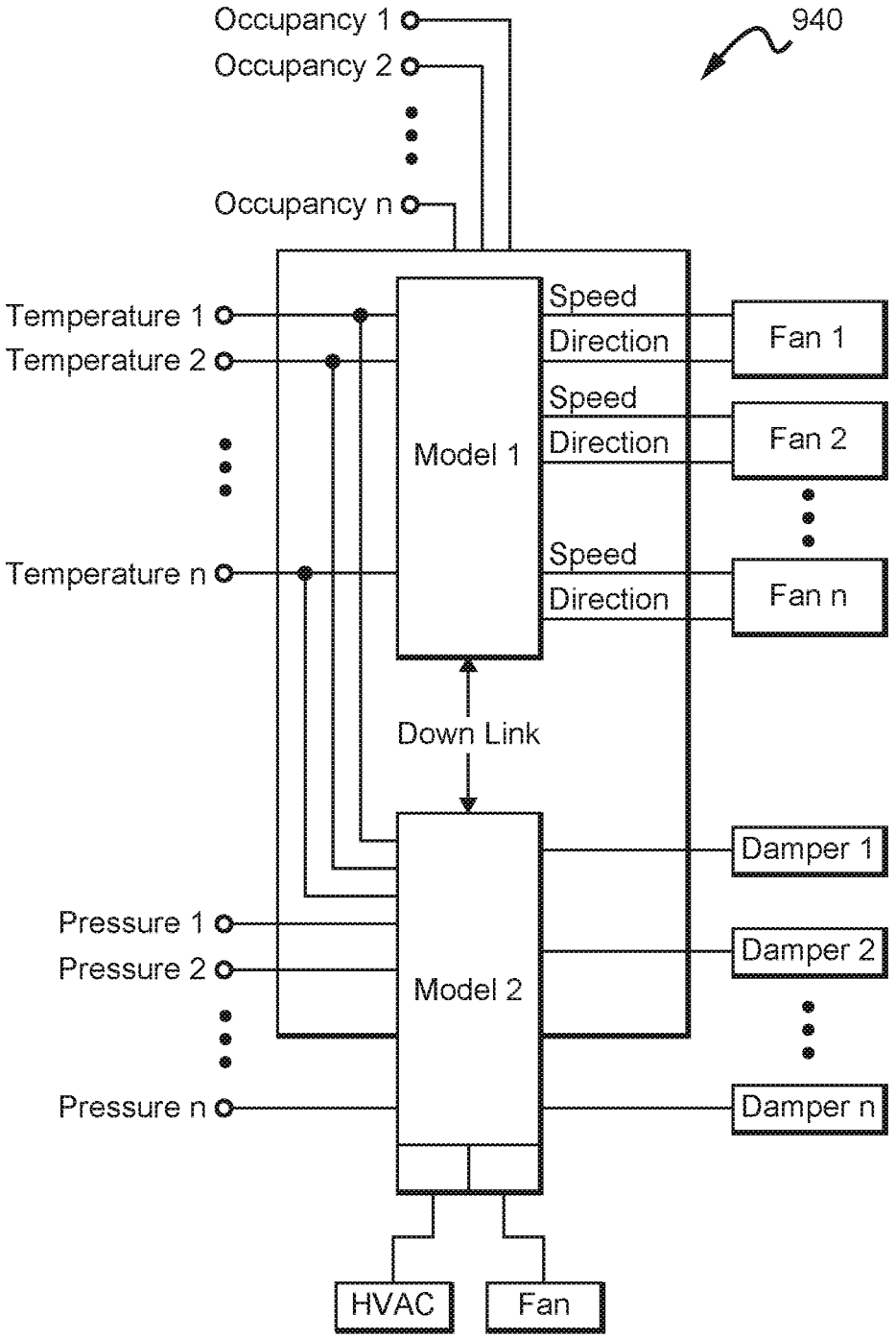
FIG. 8 Control model of the system.

The general controlling logic of one embodiment of the controller 940 is shown in FIG. 8. The controller 940 can include two modules. A first module can be configured to send out commands to control each bidirectional fan inside the transfer grilles, for example, while the other module can control the HVAC unit, its fan and dampers in the system. All of the sensors (including the pressure sensor, temperature sensor, occupancy sensor, etc, in each room) may send measurements or signals to the controller 940 for analysis.

A discussed above, each space A-F of FIG. 9 includes a cold air outlet 910 that preferably includes a damper. The outlet is connected to the AC supply via the HVAC system. Each space can have at least one transfer grille to exchange air with at least one other space. As shown in FIG. 9, the AC supply, dampers, and fans in the transfer grilles are connected to and controlled by the controller 940 independently.

The exemplary structure shown in FIG. 9 show most spaces having a single transfer grille for exchanging air with another of the spaces. Spaces 'B' and 'E' each has three transfer grilles. Thus, Space 'B' could independently exchange air with any one of Spaces 'A', 'C', and 'E'; likewise, Space 'E' could exchange air with any one of Spaces 'D', and 'F'. However, the specific number of transfer grilles and their location within a structure can and will vary depending on the specific uses of the structure and each room, and the expected occupancy levels. Because spaces 'B' and 'E' have multiple transfer grilles, they are named as relays or intermediary spaces, as the exchange of air between two other spaces might need to pass through those spaces, e.g., the air need to pass through Spaces 'B' and 'E' in order to be exchanged between Spaces 'A' and 'D'.

Figure 10:
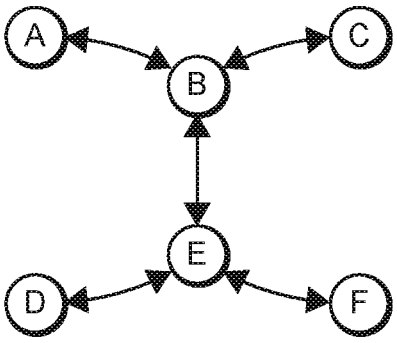
FIG. 10 illustrates a schematic of transfer grilles of some embodiments.

The six spaces and transfer grilles of FIG. 9 are shown in a simplified diagram in FIG. 10. The arrowed lines represent the air flows through the transfer grilles between the spaces, while the letters represent each of the spaces. In this example, there are three variables as input parameters to the controller; it is assumed that the HVAC is in AC mode and it is off at the beginning.

Table 1 below describes initial conditions of the current example. The status of the occupancy indicates that Space A and D are occupied and required to be maintained at specific temperature ranges. No occupancy of the other spaces means that a certain temperature requirement is not needed (e.g., the space may not need to be cooled when unoccupied). The initial temperature measurements indicate that Space A, B, and C have higher temperature than expected, while Space D, E, and F are cooler. This may occur for many reasons, such as the location of the spaces (e.g., upper level spaces will likely be warmer than lower level spaces).

The status of relay stands for the internal relations between any two spaces. In actual application, the relay status could be very complicated as a transference net. However, for the sake of simplicity, the table uses "Yes" and "No" to indicate that Space B is the junction of Space A, C and E, while Space E is the junction of Space B, D and F.

TABLE 1

Required and measured space conditions.

| | A | B | C | D | E | F |
|---|---|---|---|---|---|---|
| Occupancy | Yes | No | No | Yes | No | No |
| Higher temperature | Yes | Yes | Yes | No | No | No |
| Lower temperature | No | No | No | Yes | Yes | Yes |
| Relay | No | Yes | No | No | Yes | No |

In step one, after analyzing the initial conditions, the controller determines that the air in Spaces A and D can be mixed to ensure temperature requirements in both spaces are met and without requiring use of the HVAC unit. The controller can be programmed to determine an air exchange path via Spaces A, B, E, and D based on the layout of the transfer grilles and the relative location of the spaces. Thus, the controller can be configured to control the bi-directional fans within the transfer grille between Spaces B and E to thereby cause air to be exchanged between those spaces.

This could present three possible results, i.e., the balanced air temperature in Space B and E is higher than, lower than and equal to the expected value. For different results, the subsequent analysis and logic could be varied accordingly. Here, we assume that the balanced temperature of Space B and E is higher than expected. Then the new conditions become those shown in Table 2, with the changed values shown in underline.

TABLE 2

Measured space conditions after Step 1.

| | A | B | C | D | E | F |
|---|---|---|---|---|---|---|
| Occupancy | Yes | No | No | Yes | No | No |
| Higher temperature | Yes | Yes | Yes | No | <u>Yes</u> | No |
| lower temperature | No | No | No | Yes | <u>No</u> | Yes |
| Relay | No | Yes | No | No | Yes | No |

In step two, the controller can analyze the new results and determine, based on the analysis, what air exchange is needed. Here, the controller may determine that air should be exchanged between Spaces A and B, as well as Spaces D and E. The controller can then instruct the bi-directional fans in the transfer grilles between Spaces A and B, and between Spaces D and E to exchange air between those spaces.

For example, the controller can send a signal to the bidirectional fan at the spaces B and E transfer grille to transfer cool air from Space E to Space B, and instruct the bidirectional fan at the spaces D and E transfer grille to transfer cool air from space D to space E, and instruct the bidirectional fan at the spaces A and B transfer grille to transfer cool air from space B to space A. In an alternative embodiment, the controller can accomplish the same result by instructing the bidirectional fan at the spaces B and E transfer grille to transfer hot air from Space B to Space E, instruct the bidirectional fan at the spaces D and E transfer grille to transfer hot air from space E to space D, and instruct the bidirectional fan at the spaces A and B transfer grille to transfer hot air from space A to space B.

Note that the system is programmed to operate the HVAC system and the transfer grille system exclusively, that is, when the AC is on, the bidirectional fans are off, and vice versa. However, the HVAC system and the transfer grille system work complementary to each other. For example, when one transfer grille is on, the AC outlets in the responding two spaces will work as a return circulating tunnel to avoid accumulated high pressure in one space and low pressure in the other, even though the A/C supply is off.

It is possible that after this step, the temperature in Space A and D will be close enough to the expected temperature that no further work is needed. However, there are also various other possibilities, which for this simple case includes:

(1) Space A and B higher temperature than expected while Space D and E lower;

(2) Space A, B, D and E higher temperature than expected;

(3) Space A, B, D and E lower temperature than expected;

(4) Space A and B equal to expected temperature while Space D and E lower; or (5) Space D and E equal to expected temperature while Space A and B higher.

Depending on the measured result, the controller can send out additional commands possibilities. To continue the example below, we assume the last result (no. 5) is the current state, as show in Table 3 with the changes underlined.

TABLE 3

| Measured space conditions after Step 2. | | | | | | |
|---|---|---|---|---|---|---|
| | A | B | C | D | E | F |
| Occupancy | Yes | No | No | Yes | No | No |
| Higher temperature | Yes | Yes | Yes | No | <u>No</u> | No |
| lower temperature | No | No | No | <u>No</u> | <u>No</u> | Yes |
| Relay | No | Yes | No | No | Yes | No |

In step three, after analyzing the status of the spaces presented in Table 3, the controller determines a new air exchange path to further decrease the temperature in Space A. In this case, the new path is A↔B↔E↔F. Similar to the commands in steps 1 and 2, the temperature in Space A should be further decreased thereafter.

It is possible that the temperature in both Spaces A and D will reach expected values after these two airflow paths. However, it is also possible that after airflow in the second path, temperature in Space A may still be higher than expected. In such cirumstance, the controller may determine that it is necessary to power on the AC supply and power down the fans within the transfer grilles, since there are no other sources of cool air. Because the system could detect that only Spaces A and D are occupied and Space D is in expected temperature, only the damper in Space A can be fully opened, and the dampers in other spaces can be opened, if necessary, slightly just to avoid accumulated high pressure in the HVAC tunnels.

It is worth noticing that the transfer grilles in the above example are very simple but in real-world applications, the connections among the spaces could be much more complicated for convenient and efficient air exchange. Thereafter, at each time instant, the controller can analyze the system data to determine the most effective path to exchange the air for any two spaces to satisfy the expected air conditions.

Although our example described above illustrates an air circulation system that works along with an air conditioning unit, it is contemplated that the air circulation system of some embodiments can also work with a heating unit to achieve the same result.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for circulating airflow within a structure having first, second and third rooms, and having an air conditioning unit that supplies cool air to each of the first, second and third rooms via a duct that connects the air conditioning unit with each of a first outlet disposed at the first room, a second outlet disposed at the second room, and a third outlet disposed at the third room, wherein the first and second rooms are connected by a first transfer grille, and wherein the second and third rooms are connected by a second transfer grille, the system comprising:

a first temperature sensor disposed in the first room;

a second temperature sensor disposed in the second room;

a third temperature sensor disposed in the third room;

a first bi-directional inline fan disposed within the first transfer grille;

a second bi-directional inline fan disposed within the second transfer grille;

a controller communicatively coupled with a thermostat, the first, second and third temperature sensors, and the first and second bi-directional inline fans; and wherein the controller is configured to (a) receive temperature information from the first, second and third temperature sensors and a signal from the thermostat, (b) send a signal to the first inline fan to modulate an airflow between the first and second rooms, and (c) send a signal to the second inline fan to modulate an airflow between the second and third rooms, such that air moves from the first room to the second room and then to the third room, wherein the signals sent to the first and second inline fans are based on the signal received from the thermostat and a difference in temperature between the first and third rooms.

2. The system of claim 1, further comprising:

a first damper disposed at the first outlet and configured to control air flow to the first room;

a second damper disposed at the second outlet, and configured to control air flow to the second room;

a third damper disposed at the third outlet and configured to control air flow to the third room;

wherein the controller is communicatively coupled with the first, second and third dampers; and wherein the controller is further configured to send a signal to each of the first, second and third dampers to modulate an airflow between the first and second rooms and the second and third rooms.

3. The system of claim 1, further comprising:

a first occupancy sensor disposed in the first room;

a second occupancy sensor disposed in the second room;

a third occupancy sensor disposed in the third room;

wherein the controller is communicatively coupled with the first, second and third occupancy sensors; and wherein the controller is further configured to send the signal based on occupancy information from at least one of the first, second and third occupancy sensors.

* * * * *